US007357111B2

(12) United States Patent
Maezuru et al.

(10) Patent No.: US 7,357,111 B2
(45) Date of Patent: Apr. 15, 2008

(54) STROKE CHARACTERISTIC VARIABLE ENGINE

(75) Inventors: Akinori Maezuru, Saitama (JP); Koichi Ikoma, Saitama (JP); Koichi Eto, Saitama (JP); Kenji Abe, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 170 days.

(21) Appl. No.: 11/349,227

(22) Filed: Feb. 8, 2006

(65) Prior Publication Data

US 2006/0180117 A1 Aug. 17, 2006

(30) Foreign Application Priority Data

Feb. 14, 2005 (JP) ..... P.2005-036137

(51) Int. Cl.
*F01M 1/02* (2006.01)

(52) U.S. Cl. ..... 123/196 R; 123/48 B; 123/78 E

(58) Field of Classification Search ..... 123/196 R, 123/48 B, 78 E
See application file for complete search history.

(56) References Cited

U.S. PATENT DOCUMENTS 6,510,821 B2 * 1/2003 Fujimoto et al. ..... 123/48 B
2003/0019448 A1 * 1/2003 Aoyama et al. ..... 123/90.16

FOREIGN PATENT DOCUMENTS

JP 2004-116434 A 4/2004

* cited by examiner

*Primary Examiner*—Hieu T. Vo
*Assistant Examiner*—Katrina Harris
(74) *Attorney, Agent, or Firm*—Arent Fox LLP.

(57) ABSTRACT

A stroke characteristic variable engine comprising a primary link connected to a piston which is slidably fitted in a cylinder, a secondary link connecting the primary link with a crankshaft and a tertiary link connected to the primary link or the secondary link at one end and to an engine main body via a control shaft at the other end thereof. An oil level position of engine oil stored in an oil pan is set such that at least part of the control shaft is submerged in the engine oil, whereby since oil stored within the oil pan can be used as it is, the lubrication around the control shaft can be ensured in a simplified configuration.

7 Claims, 7 Drawing Sheets

STROKE CHARACTERISTIC VARIABLE ENGINE

The present invention claims foreign priority to Japanese patent application No. P. 2005-036137, filed on Feb. 14, 2005, the contents of which is incorporated herein by reference.

BACKGROUND OF THE INVENTION

1. Field of the Invention

The present invention relates to a stroke characteristic variable engine, and more particularly to a stroke characteristic variable engine which can simplify the supply of lubricating oil to a piston stroke variation mechanism which includes a plurality of links.

2. Description of the Background Art

There is known a stroke characteristic variable engine in which a piston and a crankshaft are connected to each other by means of a plurality of links and a piston stroke is made to be varied by varying the position of a connecting end of one (a control link) of the links to an engine main body (refer to, for example, Japanese Patent Unexamined Publication No. JP-A-2004-116434).

In the event of the engine of this type, lubricating oil needs to be supplied to connecting portions where the respective links are connected to each other and a bearing for a control shaft which varies the position of the one of the links to the engine main body. Namely, the supply of lubricating oil needs to be increased compared to general engines.

However, since the configuration of the stroke characteristic variable engine disclosed in Patent Document No. 1 is such that the capacity of a lubricating oil pump is set for a needed volume when the engine is operated at a high compression ratio and the degree of communication of oil paths provided inside the control link and the control shaft is made to vary in accordance with a change in compression ratio in order to reduce the load to be borne by the pump when the engine is run at a low compression ratio, the number of manhours for manufacture tends to be increased due to an increase in capacity of the oil pump, as well as the complex configuration of the oil paths.

SUMMARY OF THE INVENTION

In view of the drawback inherent in the related art, a main object of the invention is to improve the stroke characteristic variable engine including the plurality of links in such a manner that the supply of lubricating oil can be implemented in a simply way.

With a view to solving the problem, according to a first aspect of the invention, there is provided a stroke characteristic variable engine comprising:

a primary link 4 connected to a piston 3 which is slidably fitted in a cylinder 2;

a secondary link 5 connecting the primary link 4 with a crankshaft 6; and a tertiary link 12 comprising:

a first end connected to the primary link 4 or the secondary link 5; and a second end connected to an engine main body via a control shaft 13, wherein an oil level position of engine oil stored in an oil pan 15 is set such that at least part of the control shaft 13 is submerged in the engine oil.

In addition, according to a second aspect of the invention, there is provided a stroke characteristic variable engine comprising:

a primary link connected to a piston which is slidably fitted in a cylinder;

a secondary link connecting the primary link with a crankshaft; and a tertiary link comprising:

a first end connected to the primary link or the secondary link; and a second end connected to an engine main body via a control shaft, wherein a connecting portion is defined between the control shaft and the tertiary link, and an oil receiver (a plate-shaped semi-cylindrical portion 20) for reserving engine oil is provided between the connecting portion and an oil level in an oil pan, so that at least part of the control shaft is made to be submerged in engine oil within the oil receiver.

According to a third aspect of the present invention, as set forth in the second aspect of the present invention, it is preferable that the oil receiver is formed by a connecting member which connects together a plurality of support portions (bearing caps 18) which pivotally support the control shaft on the engine main body.

According to a fourth aspect of the present invention, as set forth in the second aspect of the present invention, it is preferable that an outlet to a crankcase of an oil return passage 22 formed in a cylinder block opens above the oil receiver.

According to a fifth aspect of the present invention, as set forth in the second aspect of the present invention, it is preferable that the oil receiver includes an oil discharge hole 21 at a lower portion thereof.

According to a sixth aspect of the present invention, it is preferable that the stroke characteristic variable engine as set forth in the second aspect of the present invention, further comprising:

a housing 33*a*, 33*b* provided with a discharge port 40 for engine oil which has flowed thereinto; and a vibration alleviating device 31 disposed in the housing, wherein a position of the discharge port of the housing is set such that oil discharged from the housing flows to fall into the oil receiver.

Furthermore, according to a seventh aspect of the invention, there is provided a stroke characteristic variable engine comprising:

a primary link connected to a piston which is slidably fitted in a cylinder;

a secondary link connecting the primary link with a crankshaft;

a tertiary link comprising:

a first end connected to the primary link or the secondary link; and a second end connected to an engine main body via a control shaft; and a vibration alleviating device housed in a housing provided with a discharge port 41 for engine oil which has flowed thereinto, wherein the position of the discharge port is set such that oil discharged from the housing is brought into contact with the control shaft.

According to the configuration provided by the first aspect of the invention, since the oil stored in the oil pan can be used as it is, the implementation of lubrication around the control shaft can be ensured by the simple configuration. In addition, according to the second aspect of the invention, since oil that spreads within the crankcase can be used, the implementation of lubrication around the control shaft can be ensured by the simple configuration, and moreover, since the oil receiver is provided at a higher position than the oil level of the oil stored in the oil pan, no effect has to be caused which would otherwise result from a change in oil level within the oil pan during the running of the engine.

By adding the configuration provided by the third aspect to the configuration provided by the second aspect of the invention, an increase in the number of components does not have to be called for, and the support rigidity of the control shaft can be increased. By adding the configuration provided by the fourth aspect to the same, engine oil can be supplied to the oil receiver in an ensured fashion without calling for a complex construction, and moreover, since the time during which engine oil stays within the oil receiver can be shortened by increasing the supply amount of oil, a deterioration in quality of oil does not have to be triggered. In addition, by adding the configuration provided by the fifth aspect, the accumulation of metallic dust and sludge can be prevented. Then, by adding the configuration provided by the sixth aspect, the supply of engine oil to the oil receiver can be ensured without calling form a complex construction. Furthermore, according to the seventh aspect of the invention, since oil that has lubricated the vibration alleviating device can be used, the implementation of lubrication around the control shaft can be ensured by the simple configuration.

DETAILED DESCRIPTION OF THE PREFERRED EMBODIMENTS

Figure 1:
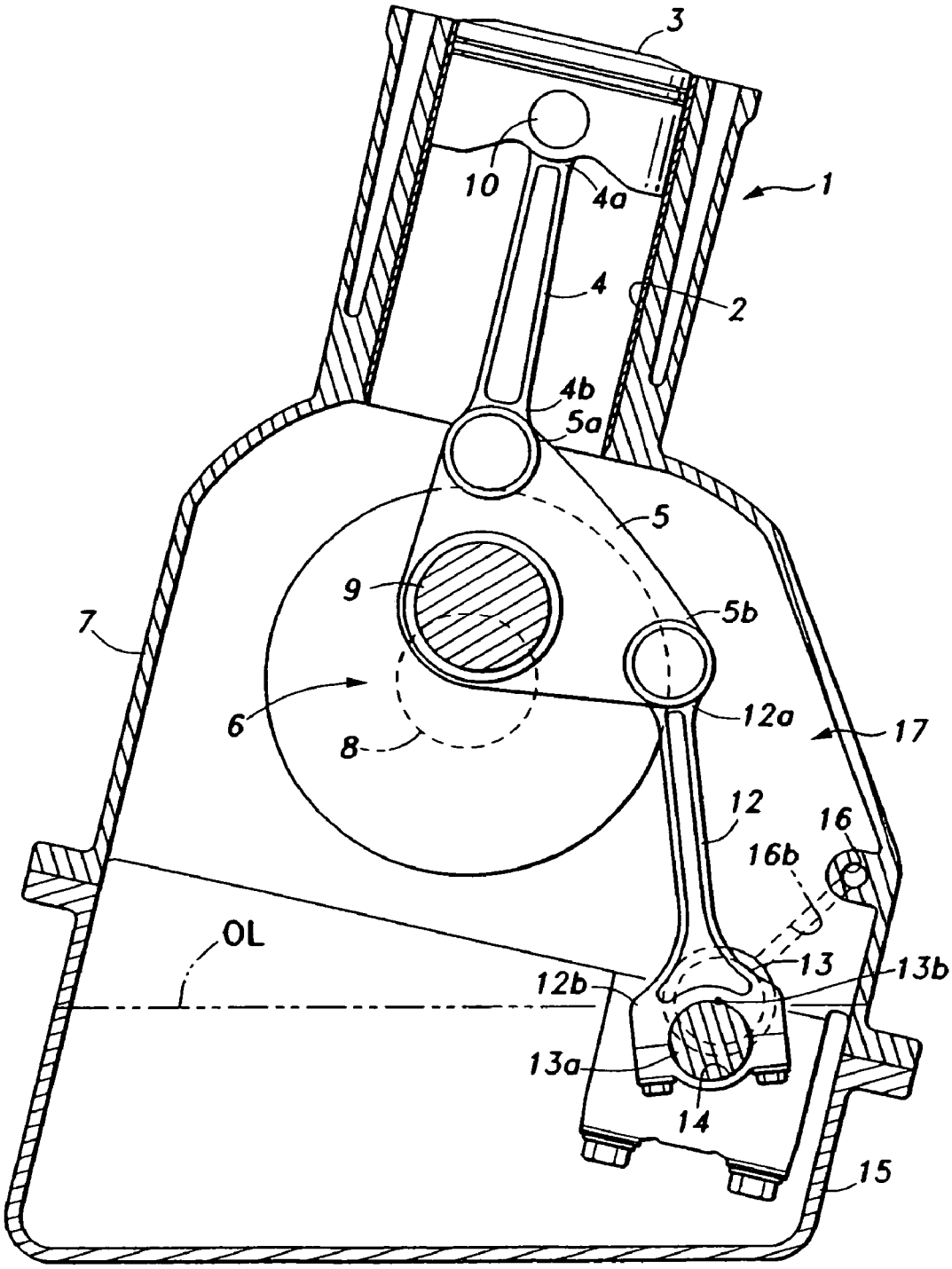
FIG. 1 is a vertical sectional view which shows a top dead center of a piston of an engine to which the invention is applied in a high compression state.

The invention will be described in detail by reference to the accompanying drawings.

Embodiment 1

FIGS. 1 to 4 are schematic views which show the configuration of a compression ratio variable engine as an example of a stroke characteristic variable engine to which the invention is applied with a cylinder head and an upper part of the engine than the cylinder head omitted from the illustration. For ease of understanding, the description will be made on one of pistons of the engine and associated components therewith. A piston 3, which is slidably fitted in a cylinder 2 of the engine 1, is connected to a crankshaft 6 via two links, a primary link 4 and a secondary link 5.

The crankshaft 6 supports the secondary link 5, which oscillates in a see-saw fashion, at a middle portion thereof by a crank pin 9 which is offset from a crank journal 8 (a rotational center of the crankshaft) which is supported within a crankcase 7. Then, a big end portion 4*b* of the primary link 4, which is connected to a piston pin 10 at a small end thereof, is connected to one end 5*a* of the secondary link 5.

Note that the crankshaft 6 is configured basically similar to that of a normal fixed compression ratio engine in which a counterweight, which offsets a vibration component generated by the motion of the piston, is formed integrally on a crank arm which connects the crank journal 8 to the crank pin 9.

A small end portion 12*a* of a tertiary link 12, which has the same configuration as that of a connecting rod which connects a piston to a crankshaft in a normal engine, is pin connected to the other end 5*b* of the secondary link 5. In addition, a bid end portion 12*b* of the tertiary link 12 is connected by a bearing bore 14 which is divided into two halves to an eccentric portion 13*a* of the control shaft 13 which is made up of an eccentric shaft which is rotatably supported within the crankcase 7 and is provided in such a manner as to extend in parallel with the crankshaft 6.

The control shaft 13 supports the big end portion 12*b* of the tertiary link 12 in such a manner that the big end portion 12*b* can move within a predetermined range within the crankcase 7 and is made such that the rotational angle of the control shaft 13 is changed continuously in accordance with the running state of the engine 1 and is held at an arbitrary angle by means of a stroke characteristic variation control actuator (not shown) which is provided at a shaft end of the control shaft 13 which protrudes outwardly of the crankcase 7.

Figure 2:
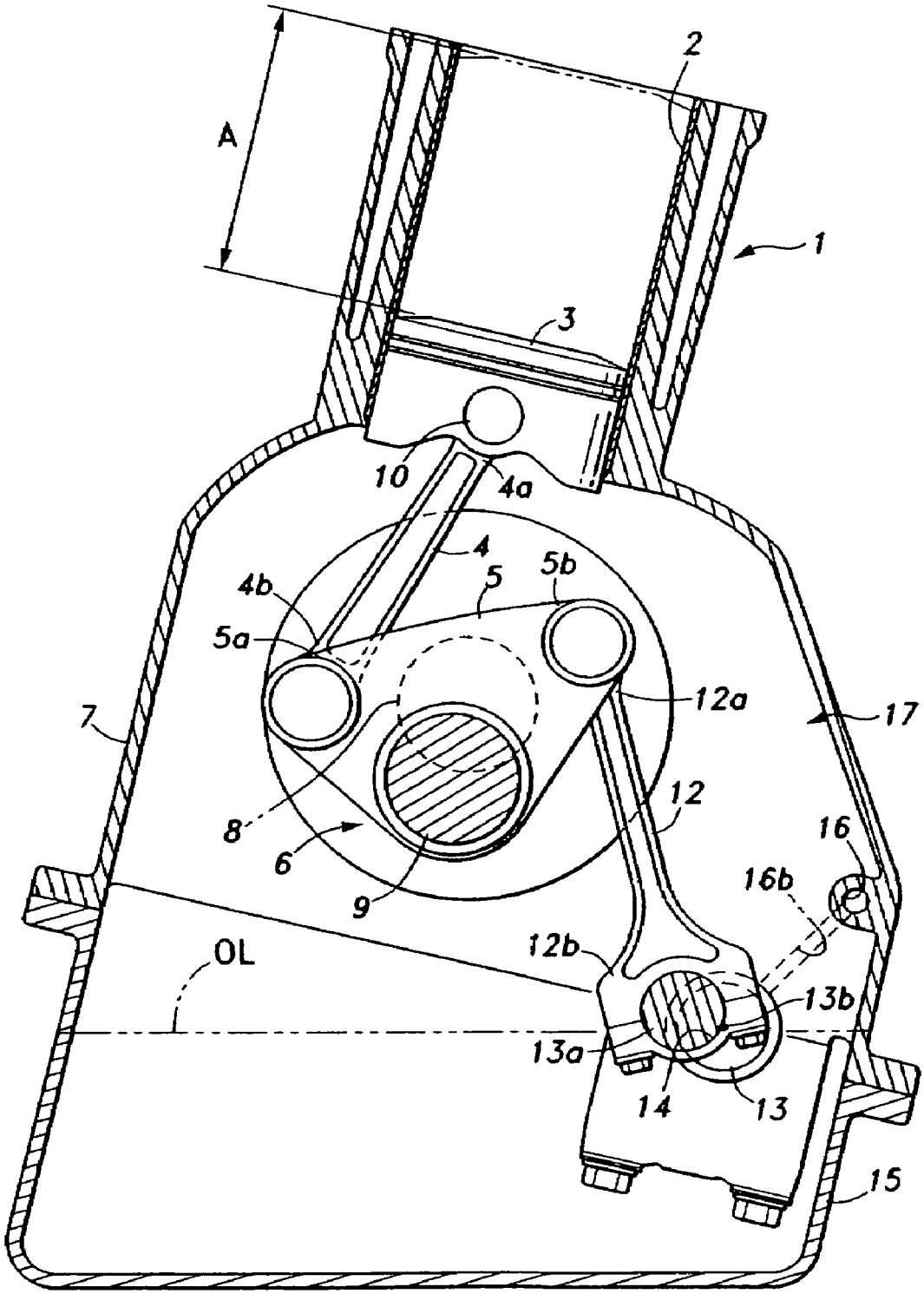
FIG. 2 is a vertical sectional view which shows a bottom dead center of the piston of the engine to which the invention is applied in the high compression state.
Figure 3:
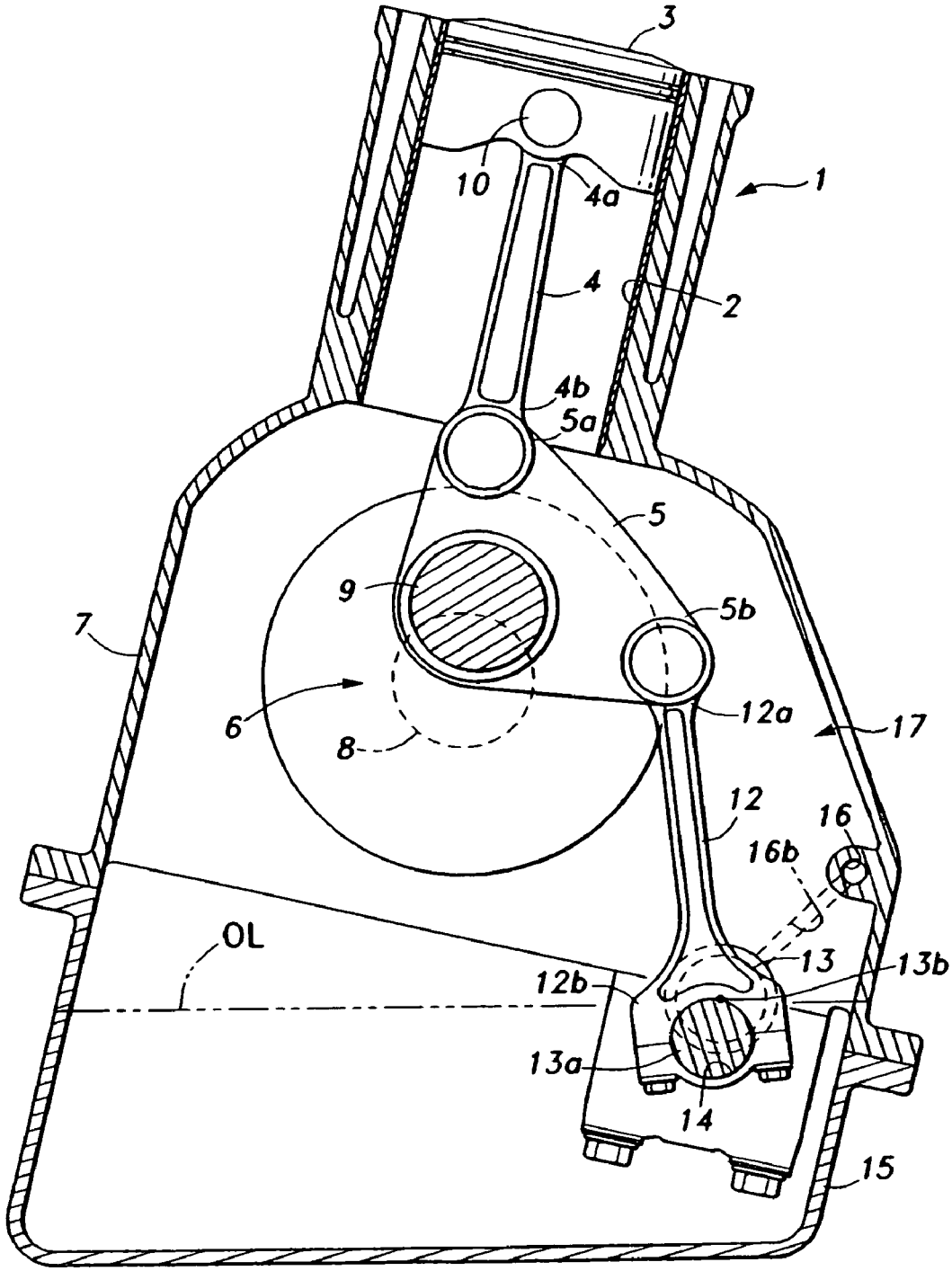
FIG. 3 is a vertical sectional view which shows the top dead center of the piston of the engine to which the invention is applied in a low compression state.
Figure 4:
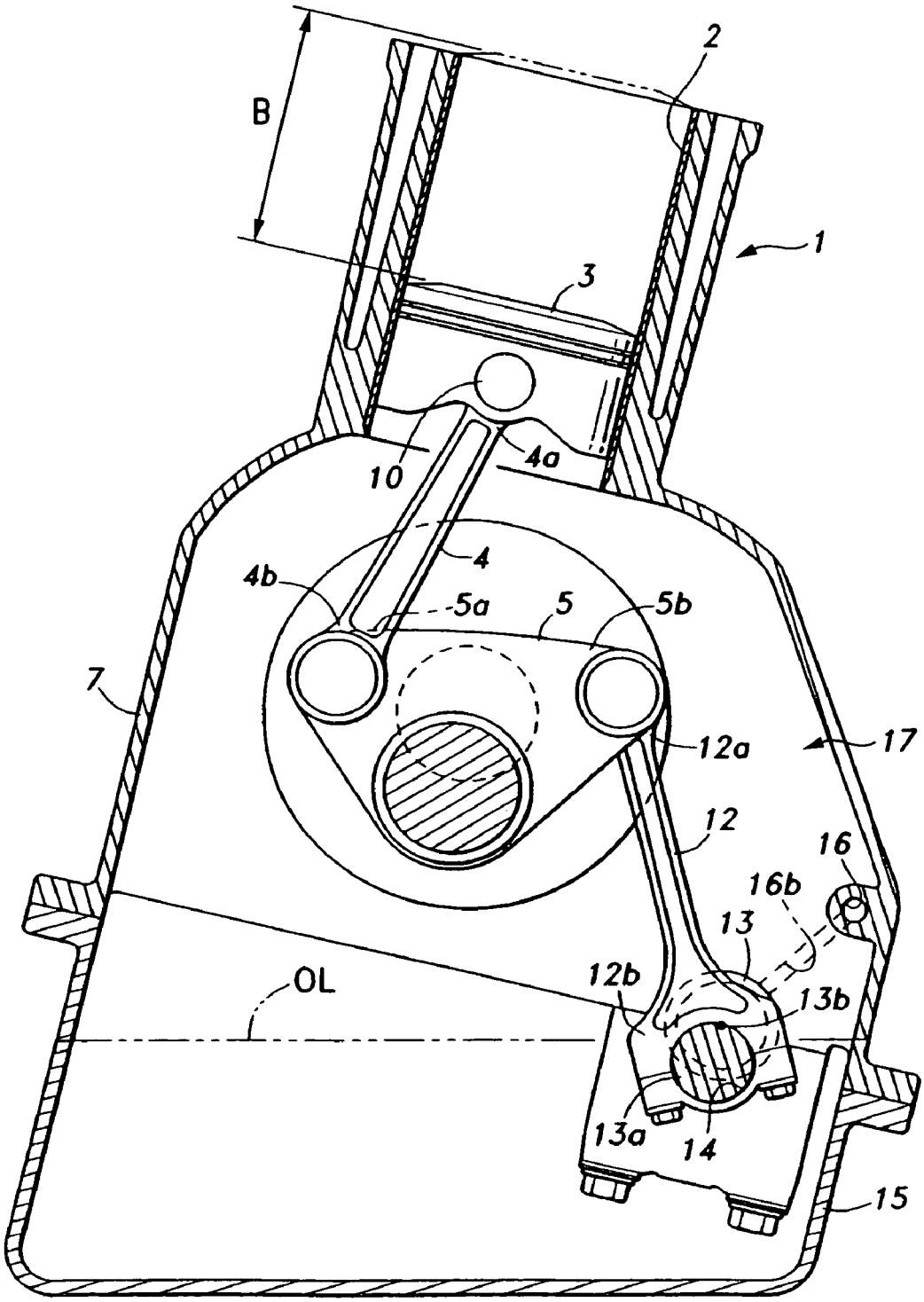
FIG. 4 is a vertical sectional view which shows the bottom dead center of the piston of the engine to which the invention is applied in the low compression state.

According to this engine 1, the position of the big end portion 12*b* of the tertiary link 12 varies between a position shown in FIGS. 1 and 2 and a position shown in FIGS. 3 and 4 by rotating the control shaft 13, whereby the oscillating angle of the secondary link 5 varies in conjunction with the rotation of the crankshaft 6. The range of a stroke of the piston 3 within the cylinder 2, that is, a top dead center position and a bottom dead center position of the piston 3 vary continuously between a range indicated by reference character A in FIG. 2 and a range indicated by reference character B in FIG. 4 in accordance with the oscillating angle of the secondary link 5. Namely, a piston stroke variation mechanism is made up of the primary to tertiary links 4, 5, 12 and the control shaft 13, whereby a stroke characteristic varying function is provided which varies continuously at least either compression ratio or displacement.

In this engine 1, a cylinder axis is inclined relative to a vertical line, and engine oil is stored by an oil pan 15 which is connected to a bottom of the crankcase 7. In addition, the height of an oil level OL of engine oil is set such that a connecting portion where the big end portion 12*b* of the tertiary link 12 and the control shaft 13 are connected to each other is partially submerged in engine oil so stored.

Thus, since engine oil stored within the oil pan 15 can be used, as it is, for lubrication of the connecting portion where the big end portion 12*b* of the tertiary link 12 and the control shaft 13 are connected to each other and a pivotal securing portion where the control shaft 13 is pivotally supported to an engine main body by setting the height of the oil level OL of engine oil stored in the oil pan 15 such that at least part of the control shaft 13 is submerged in the engine oil so stored, oil paths for supplying lubricating oil to the tertiary link 12 and the control shaft 13 do not have to be formed, whereby the implementation of lubrication around the control shaft can be ensured by the simple configuration.

In addition, as to lubrication of the pivotal securing portion where the control shaft 13 is pivotally supported to the engine main body, a branch path 16*b* from a oil path, which is provided inside the crankcase 7 to supply engine oil to, for example, the crank journal 8 or the like, may, needless to say, be provided inside both end walls of the crankcase 7 in a direction in which cylinders are aligned, as well as bulkheads 17 which are each formed inside the crankcase 7 to separate adjacent cylinders from each other.

Embodiment 2

Figure 5:
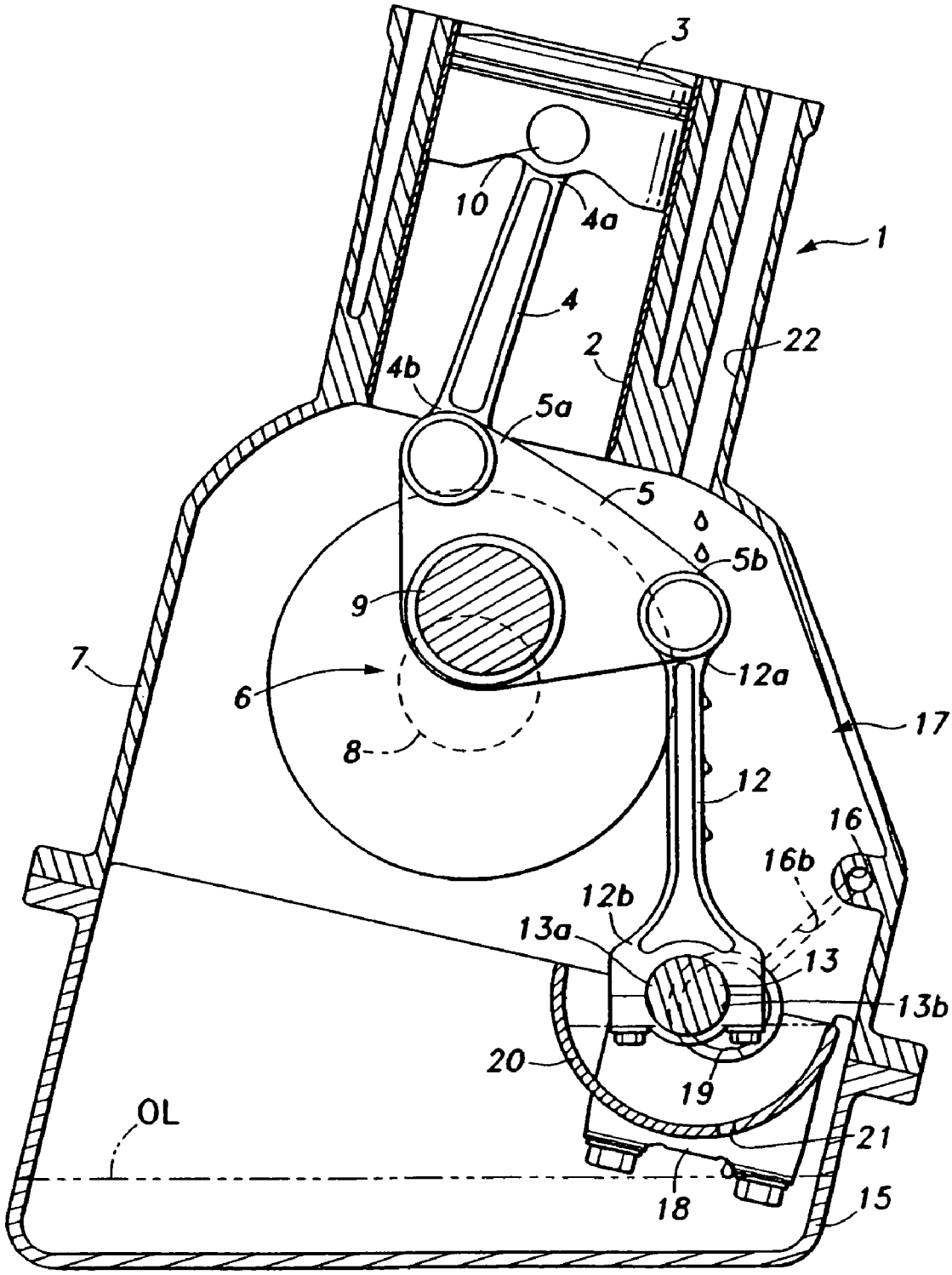
FIG. 5 is a vertical sectional view which shows a second embodiment of the invention, in which an internal mechanism of an engine is shown in the same manner as in FIG. 1.

FIG. 5 is a schematic view, similar to FIG. 1, which shows the configuration of a second embodiment of the invention. In this embodiment, too, since the configuration of a piston stroke variation mechanism is not different at all from that of the first embodiment, the description thereof will be omitted.

A control shaft 13 is supported within a lower portion of a crankcase 7 by bearing bores 19 which are formed in such a manner as to be divided into two halves between lower surfaces of both end walls of the crankcase 7 in a direction in which cylinders are aligned and a plurality of bulkheads 17 formed within the crankcase 7 to separate adjacent cylinders 2 from each other and a plurality of bearing caps 18 which are joined, respectively, to the lower surfaces of the end walls and bulkheads 17.

In this embodiment, the plurality of bearing caps 18 are integrally connected to each other by plate-shaped semi-cylindrical portions 20 which are each formed into a curved semi-cylindrical shape which protrudes downwardly. This plate-shaped semi-cylindrical portion 20 covers below a connecting portion where a big end portion 12*b* of a tertiary link 12 is connected to the control shaft 13 and is disposed at a higher position than an oil level OL of engine oil stored within an oil pan 15. In addition, in this plate-shaped semi-cylindrical portion 20, an open surface thereof is oriented upwardly and a oil discharge hole 21 having an appropriate bore diameter is provided at an appropriate position in a lower portion thereof, whereby the plate-shaped semi-cylindrical portion 20 functions as an oil receiver which receives engine oil which spreads within the crankcase 7.

On the other hand, an oil return passage 22 is formed outside the cylinder 2 within a cylinder block to return engine oil from a cylinder head to the oil pan 15, and an outlet of this oil return passage 22 to the inside of the crankcase 7 is made to open at a position which faces the open surface of the plate-shaped semi-cylindrical portion 20.

According to this configuration, engine oil falling from the oil return passage 22 flows downwards, for example, along the tertiary link 12 into the plate-shaped semi-cylindrical portion 20 (the oil receiver) and flows out through the oil discharge hole 21. Here, the bore diameter of the oil discharge hole 21 is determined in consideration of a balance between a flow-in volume and a flow-out volume so that not only the accumulation of metallic dust and sludge can be prevented but also a sufficient amount of engine oil can be accumulated to allow the connecting portion between the big end portion 12*b* of the tertiary link 12 and the control shaft 13 to be submerged in engine oil so accumulated.

Thus, since engine oil which spreads within the crankcase 7 can be received to thereby be used to lubricate around the control shaft by providing the plate-shaped semi-cylindrical portion 20 which functions as the oil receiver for temporarily reserving engine oil between the connecting portion where the big end portion 12*b* of the tertiary link 12 is connected to the control shaft 13 and the oil level OL within the oil pan, so as to allow at least part of the control shaft 13 to be submerged in engine oil reserved within the plate-shaped semi-cylindrical portion 20, a complex lubricating construction does not have to be called for.

In addition, engine oil within the plate-shaped semi-cylindrical portion 20 is replaced at all times, a deterioration in oil quality does not have to be triggered, and additionally, since the plate-shaped semi-cylindrical portion 20 is provided at the higher position than the oil level OL of engine oil within the oil pan 15, no effect has to be caused which would otherwise result from a change in oil level within the oil pan during the running of the engine. Moreover, since the plurality of bearing caps 18 are configured as a single component in which the bearing caps 18 are connected to each other, an increase in the number of components does not have to be called for, and the configuration can contribute to an enhancement in the support rigidity of the control shaft 13.

Embodiment 3

Since this stroke characteristic variable engine 1 generates rotational secondary vibration attributed to the motion of the piston stroke variation mechanism, a vibration alleviating device for offsetting the vibration may be provided below the crankshaft 6.

Figure 6:
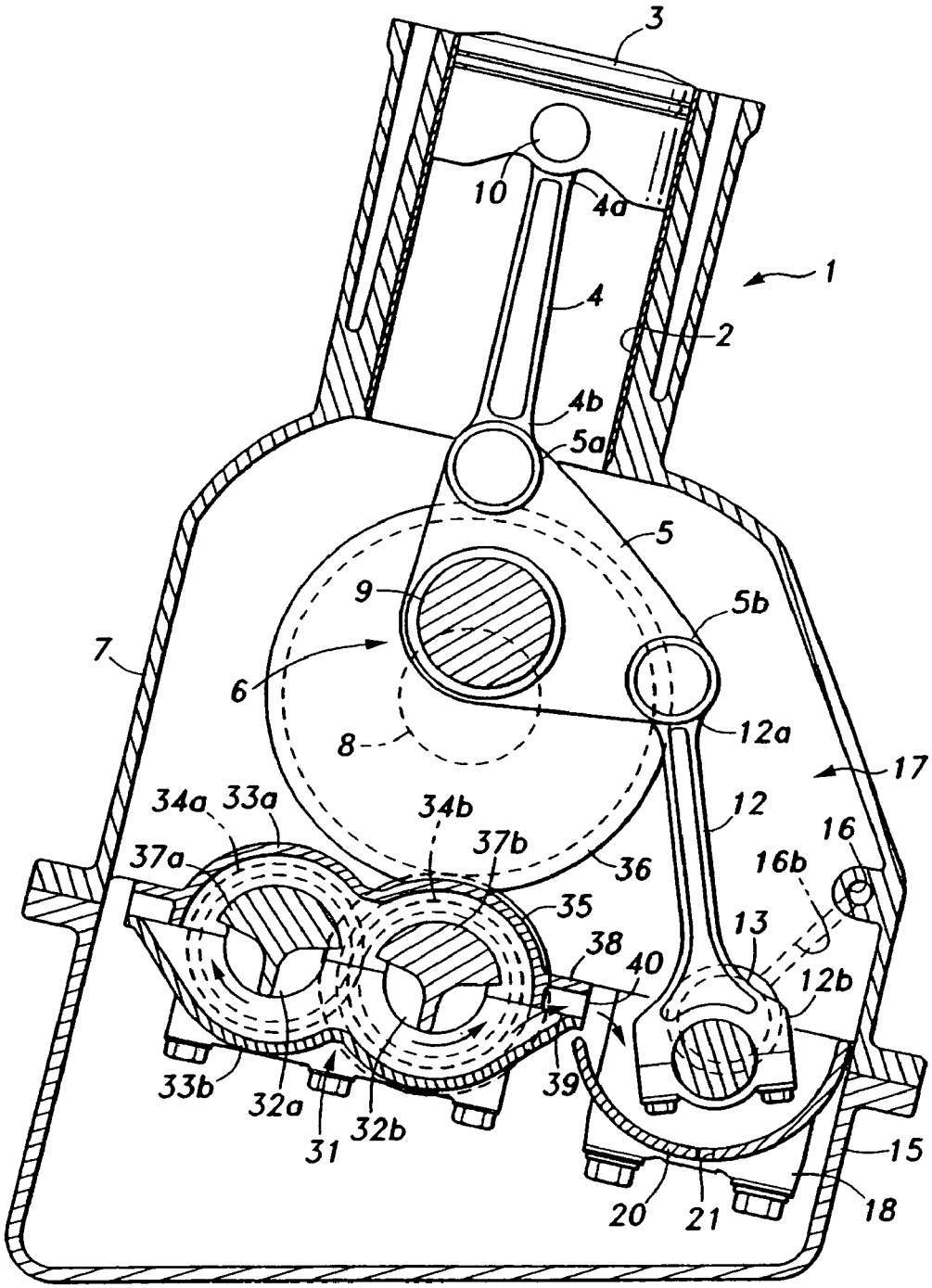
FIG. 6 is a vertical sectional view which shows a third embodiment of the invention, in which an internal mechanism of an engine is shown in the same manner as in FIG. 1.

FIG. 6 shows an example of a vibration alleviating device 31 provided at a position adjacent to the control shaft 13.

This vibration alleviating device 31 includes a pair of balancer shafts 32*a*, 32*b* which both extend in parallel with the crankshaft 6 and an upper housing 33*a* and a lower housing 33*b* which are divided halves and which support and receive the balancer shafts 32*a*, 32*b*. The balancer shafts 33*a*, 33*b* are connected to each other by virtue of mesh engagement between interlocking gears 34*a*, 34*b* having the same diameter which are provided integrally on the balancer shafts 32*a*, 32*b*, respectively, and a driven gear 35 provided on one of the balancer shafts, which is the balancer shaft 32*b* (lying directly below the crankshaft 6), meshes with a drive gear 36 provided on the crankshaft 6, whereby the driving force of the crankshaft 6 is transmitted to the respective balancer shafts 32*a*, 32*b*, which are then caused to rotate in an opposite direction at a rotating speed which is twice the crankshaft speed.

Balancer weights 37*a*, 37*b* are provided on outer circumferential portions of the balancer shafts 32*a*, 32*b*, respectively, which each have a predetermined phase and a predetermined inertial mass which are necessary to balance an amount of unbalance generated by the motion of the piston stroke variation mechanism.

Side edges of side walls of the upper housing 33*a* and the lower housing 33*b* are offset from each other along a parting surface between the upper housing 33*a* and the lower housing 33*b* with respect to a radial direction of the balancer shafts 32*a*, 32*b*. In addition, lateral protruding portions 38 are provided on side walls of the upper housing 33*a* in such a manner as to extend in an axial direction of the housing, whereby upwardly open gaps 39 are formed on a plane on which centers of the balancer shafts 32*a*, 32*b* pass and open surfaces of the gaps 39 and the lateral protruding portions 38 are made to oppositely face each other, so that oil discharge ports 40, which are opened sideways, are defined between the side edges of the side walls of the lower housing 33*b* and side edges of the lateral protruding portions 38, respectively.

By this configuration, engine oil, which flows in from an oil inlet hole (not shown) formed in the upper housing 33*a* to be accumulated in a bottom portion of the lower housing 33*b*, is scooped up by both the balancer shafts 32*a*, 32*b* in conjunction with the rotation thereof (in directions indicated by arrows) to flow sideways out of the vibration alleviating device 31 from the discharge ports 40 via the gaps 38.

In this embodiment, an open side edge of each plate-shaped semi-cylindrical portion 20, which is similar to that described in the second embodiment, is disposed adjacent to the side edge of the right-hand side wall of the lower housing 33*b*, and the discharge port 40 is positioned so as to open above the open side edge of the plate-shaped semi-cylindrical portion 20, whereby engine oil flowing out of the vibration alleviating device 31 is designed to flow into the plate-shaped semi-cylindrical portion 20. In addition, as with the second embodiment, a connecting portion where a big end portion 12*b* of a tertiary link 12 is connected to a control shaft 13 is lubricated by engine oil accumulated within the plate-shaped semi-cylindrical portion 20. Namely, the implementation of supply of engine oil to the surroundings of the control shaft can be ensured by the construction of the embodiment without calling for a complex lubricating construction.

Embodiment 4

Figure 7:
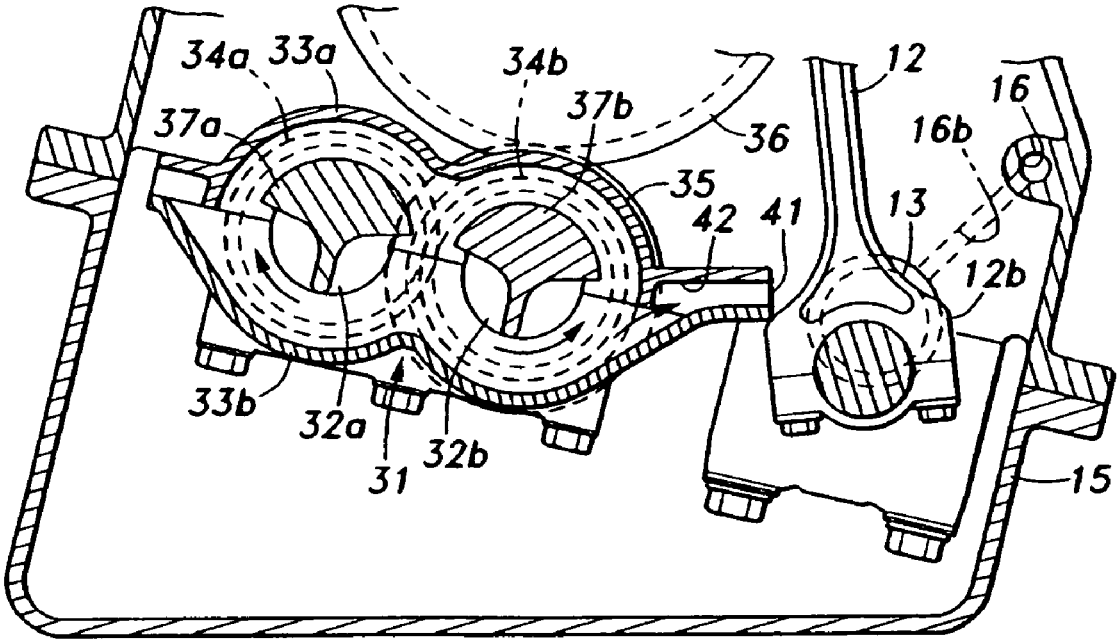
FIG. 7 is a vertical sectional view which shows a main part of a fourth embodiment of the invention.

As shown in FIG. 7, in the event that an oil discharge path 42 is made to extend from right-hand side walls of an upper housing 33*a* and a lower housing 33*b* of a vibration alleviating device 31 at a position which does not interfere with a big end portion 12*b* of a tertiary link 12 in such a manner that a discharge port 41 thereof is made to open at a position which lies near a control shaft 13, engine oil which has lubricated the vibration alleviating device 31 can be supplied directly to the control shaft 13. According to this configuration, since the plate-shaped semi-cylindrical portions 20 which function as the oil receivers can be omitted, the lubricating construction for the surroundings of the control shaft can be simplified further. In addition, since the supply of engine oil to the surroundings of the control shaft can be ensured even in the vent that the control shaft 13 is spaced apart from the vibration alleviating device 31, the degree of freedom in layout of the accessory components can be enhanced even in case the plate-shaped portions 20 are used. Note that a configuration may be adopted in which instead of the oil discharge path 42, a pipe made up of a separate member is connected to the right-hand side walls of the upper housing 32*a* and the lower housing 32*b* of the vibration alleviating device 31.

Thus, as has been described in detail heretofore, the invention can be applied equally to engines in which piston strokes are varied by varying the geometry of a plurality of links, whereby at least a compression ratio or displacement thereof can be varied, and can be applied to, for example, an engine of a type in which one end of a tertiary link is connected to the vicinity of a connecting portion where a primary link is connected to a secondary link.

While there has been described in connection with the preferred embodiments of the present invention, it will be obvious to those skilled in the art that various changes and modification may be made therein without departing from the present invention, and it is aimed, therefore, to cover in the appended claim all such changes and modifications as fall within the true spirit and scope of the present invention.

What is claimed is:

1. A stroke characteristic variable engine comprising:

a primary link connected to a piston which is slidably fitted in a cylinder having an inclined axis relative to a vertical line;

a secondary link connecting the primary link with a crankshaft; and a tertiary link comprising:

a first end connected to the primary link or the secondary link; and a second end connected to an engine main body via a control shaft, wherein an oil level position of engine oil stored in an oil pan is set such that at least part of the control shaft is submerged in the engine oil;

the control shaft is positioned lateral of the crank shaft; and the cylinder axis inclines to the control shaft side.

2. A stroke characteristic variable engine comprising:

a primary link connected to a piston which is slidably fitted in a cylinder;

a secondary link connecting the primary link with a crankshaft; and a tertiary link comprising:

a first end connected to the primary link or the secondary link; and a second end connected to an engine main body via a control shaft, wherein a connecting portion is defined between the control shaft and the tertiary link, and an oil receiver for reserving engine oil is provided between the connecting portion and an oil level in an oil pan so as to cover a lower side of the connecting portion, so that at least part of the control shaft is made to be submerged in engine oil within the oil receiver.

3. The stroke characteristic variable engine as set forth in claim 2, wherein the oil receiver is formed by a connecting member which connects together a plurality of support portions which pivotally support the control shaft on the engine main body.

4. The stroke characteristic variable engine as set forth in claim 2, wherein an outlet to a crankcase of an oil return passage formed in a cylinder block opens above the oil receiver.

5. The stroke characteristic variable engine as set forth in claim 2, wherein the oil receiver includes an oil discharge hole at a lower portion thereof.

6. The stroke characteristic variable engine as set forth in claim 2, further comprising:

a housing provided with a discharge port for engine oil which has flowed thereinto; and a vibration alleviating device disposed in the housing, wherein a position of the discharge port of the housing is set such that oil discharged from the housing flows to fall into the oil receiver.

7. The stroke characteristic variable engine comprising:

a primary link connected to a piston which is slidably fitted in a cylinder;

a secondary link connecting the primary link with a crankshaft;

a tertiary link comprising:

a first end connected to the primary link or the secondary link; and a second end connected to an engine main body via a control shaft; and a vibration alleviating device housed in a housing provided with a discharge port for engine oil which has flowed thereinto, wherein the position of the discharge port is set such that oil discharged from the housing is brought into contact with the control shaft.

* * * * *